US009890744B2

(12) United States Patent
Li

(10) Patent No.: US 9,890,744 B2
(45) Date of Patent: Feb. 13, 2018

(54) ROUTE AND TRAFFIC INFORMATION-BASED EVAP SYSTEM LEAK TEST INITIATION

(71) Applicant: Ford Global Technologies, LLC, Dearborn, MI (US)

(72) Inventor: Yonghua Li, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 407 days.

(21) Appl. No.: 14/455,742

(22) Filed: Aug. 8, 2014

(65) Prior Publication Data

US 2016/0040630 A1 Feb. 11, 2016

(51) Int. Cl.
*F02M 25/08* (2006.01)

(52) U.S. Cl.
CPC ..... *F02M 25/0809* (2013.01); *F02M 25/0827* (2013.01)

(58) Field of Classification Search
CPC ..... F02M 25/0809; F02M 25/0827; F02M 65/006
See application file for complete search history.

(56) References Cited

U.S. PATENT DOCUMENTS 6,089,081 A 7/2000 Cook et al.
8,315,775 B2 11/2012 Biondo et al.
8,532,907 B2 9/2013 Taguchi
8,725,408 B2 5/2014 Hochkirchen et al.
2005/0044940 A1* 3/2005 Nakoji ..... F02M 25/0818 73/114.41
2005/0131634 A1 6/2005 Ignatin
2007/0087756 A1* 4/2007 Hoffberg ..... G06Q 10/0631 455/450

FOREIGN PATENT DOCUMENTS

JP 2003278610 A * 10/2003

OTHER PUBLICATIONS

Matsuoka et al. (JP 2003-278610 A), Oct. 2003, JPO Computer Translation.*
Anonymous, "A Method to Infer Vehicle Fuel Type Via GPS Location and Mapped Seasonal Fuel Information," IPCOM No. 000235552, Published Mar. 7, 2014, 2 pages.
Dudar, Aed M., "System and Methods for Evaporative Emissions Leak Detection Based on a Vehicle," U.S. Appl. No. 14/054,718, filed Oct. 15, 2013, 35 pages.

* cited by examiner

*Primary Examiner* — Erika J Villaluna
(74) *Attorney, Agent, or Firm* — James Dottavio; McCoy Russell LLP

(57) ABSTRACT

Systems and methods for performing evaporative emissions leak detection in a vehicle are provided. In one embodiment, a method comprises initiating a leak test via an electronic controller in a vehicle responsive to selected route conditions. In this way, a leak test may run without premature termination, therefore saving resources.

18 Claims, 7 Drawing Sheets

ROUTE AND TRAFFIC INFORMATION-BASED EVAP SYSTEM LEAK TEST INITIATION

BACKGROUND AND SUMMARY

Vehicles are capable of performing on-board diagnostics to identify leaks in the fuel system. Some diagnostics tests are performed while the engine is running in order to utilize engine intake vacuum. Some tests may be performed in response to the activation of a cruise control mode, as such a mode indicates that the vehicle will be traveling steadily and for a long enough period of time for the test to complete.

However, initiating a leak test whenever cruise control is enabled may result in false fails and/or a waste of resources, since cruise control may be terminated for a variety of reasons. For example, traffic may suddenly be congested due to an accident and cruise control may be disabled when the vehicle slows down or comes to a stop. As another example, a driver may turn on cruise control for a short period of time before arriving at his or her destination. Upon arrival at the destination, the leak test is terminated when cruise control is disabled or the engine turns off.

The inventor herein has recognized the above issues and has devised various approaches to address them. In one embodiment, a method comprises initiating a leak test via an electronic controller in a vehicle responsive to selected route conditions. In this way, a leak test may run without premature termination, therefore saving resources.

In another embodiment, a method comprises evaluating a projected route responsive to receiving a cruise control signal, and initiating a leak test responsive to selected entry conditions. In this way, a leak test may run based on predicted success of the leak test.

In another embodiment, a method comprises initiating a leak test responsive to receiving a cruise control signal, and modifying adaptive cruise control acceleration limits responsive to initiating the leak test. In this way, a leak test may not be disturbed by automatic acceleration and deceleration of a vehicle.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

DETAILED DESCRIPTION

Figure 2:
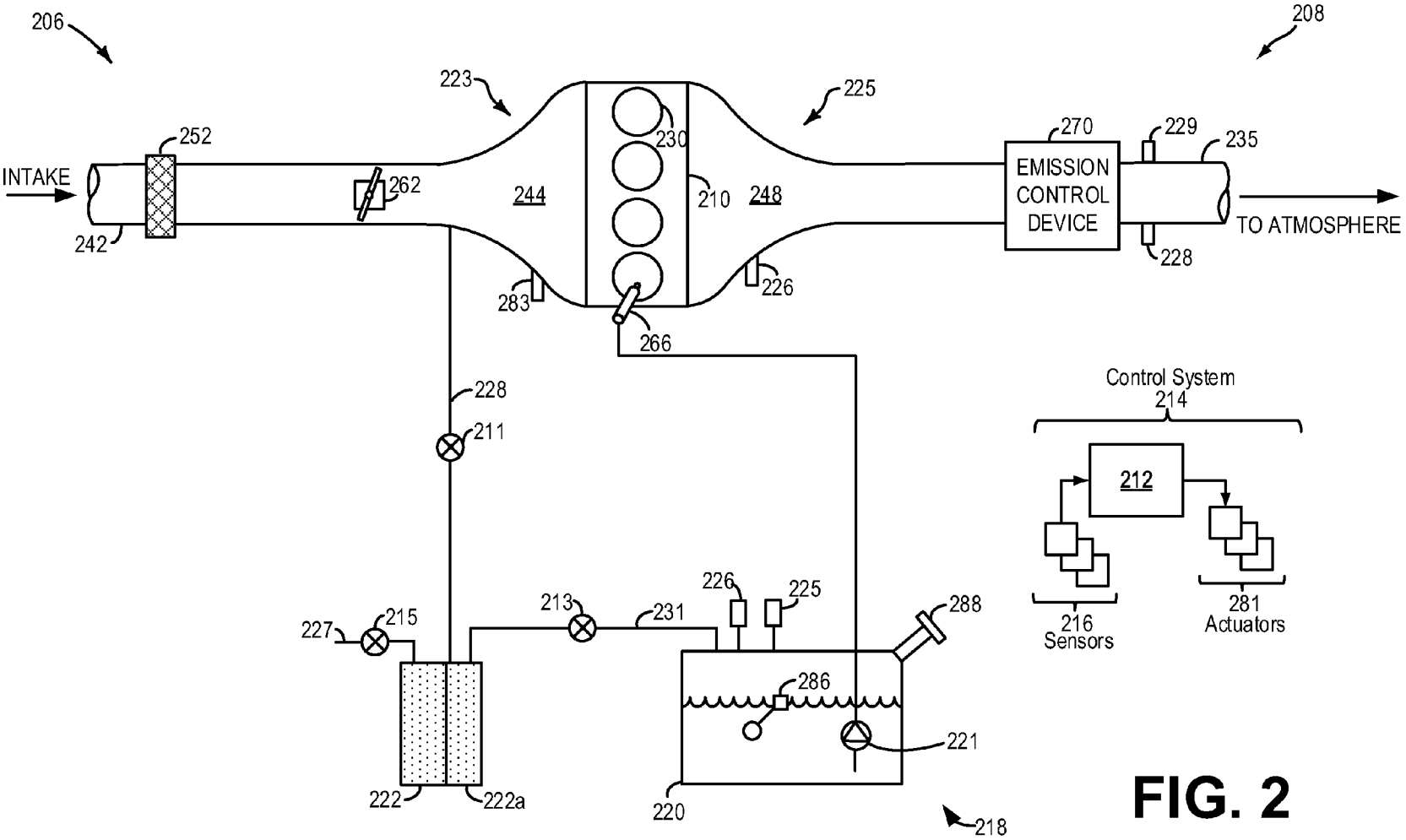
FIG. 2 shows an example engine system coupled to a fuel system.
Figure 3:
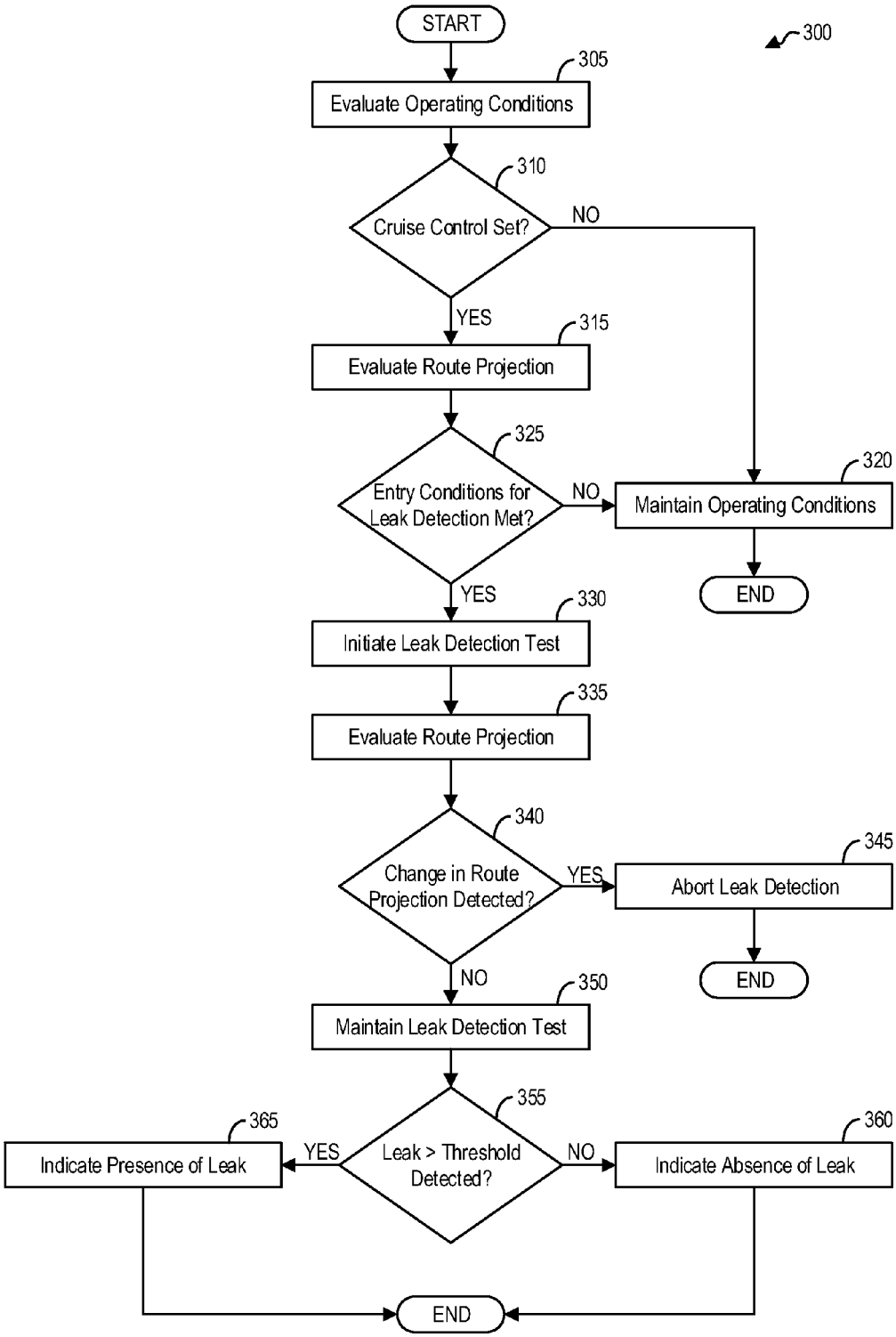
FIG. 3 shows a high-level flow chart illustrating an example method for using a route projection to initiate and abort a leak detection test during a cruise control mode.
Figure 4:
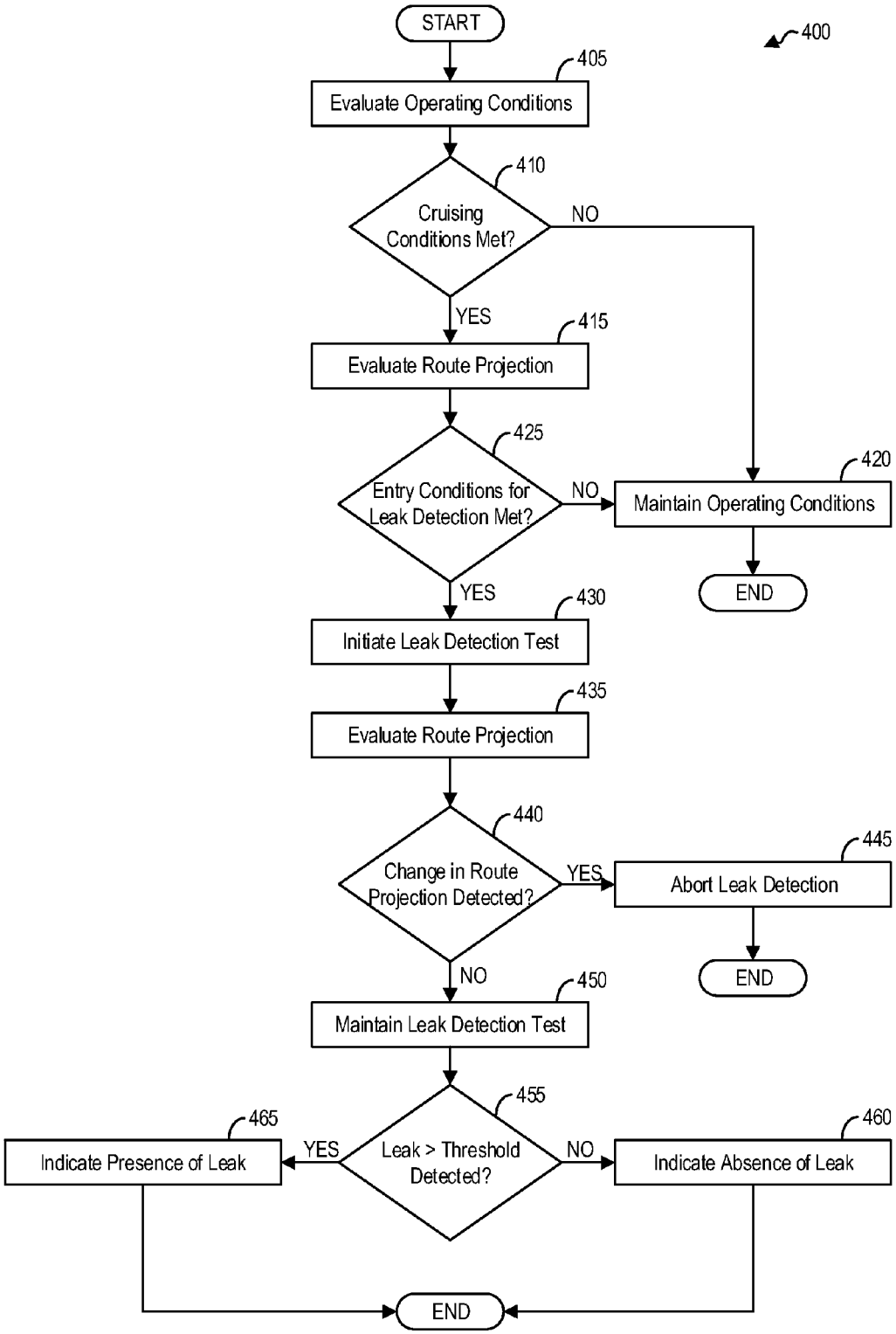
FIG. 4 shows a high-level flow chart illustrating an example method for using a route projection to initiate and abort a leak detection test during a cruising mode.
Figure 5:
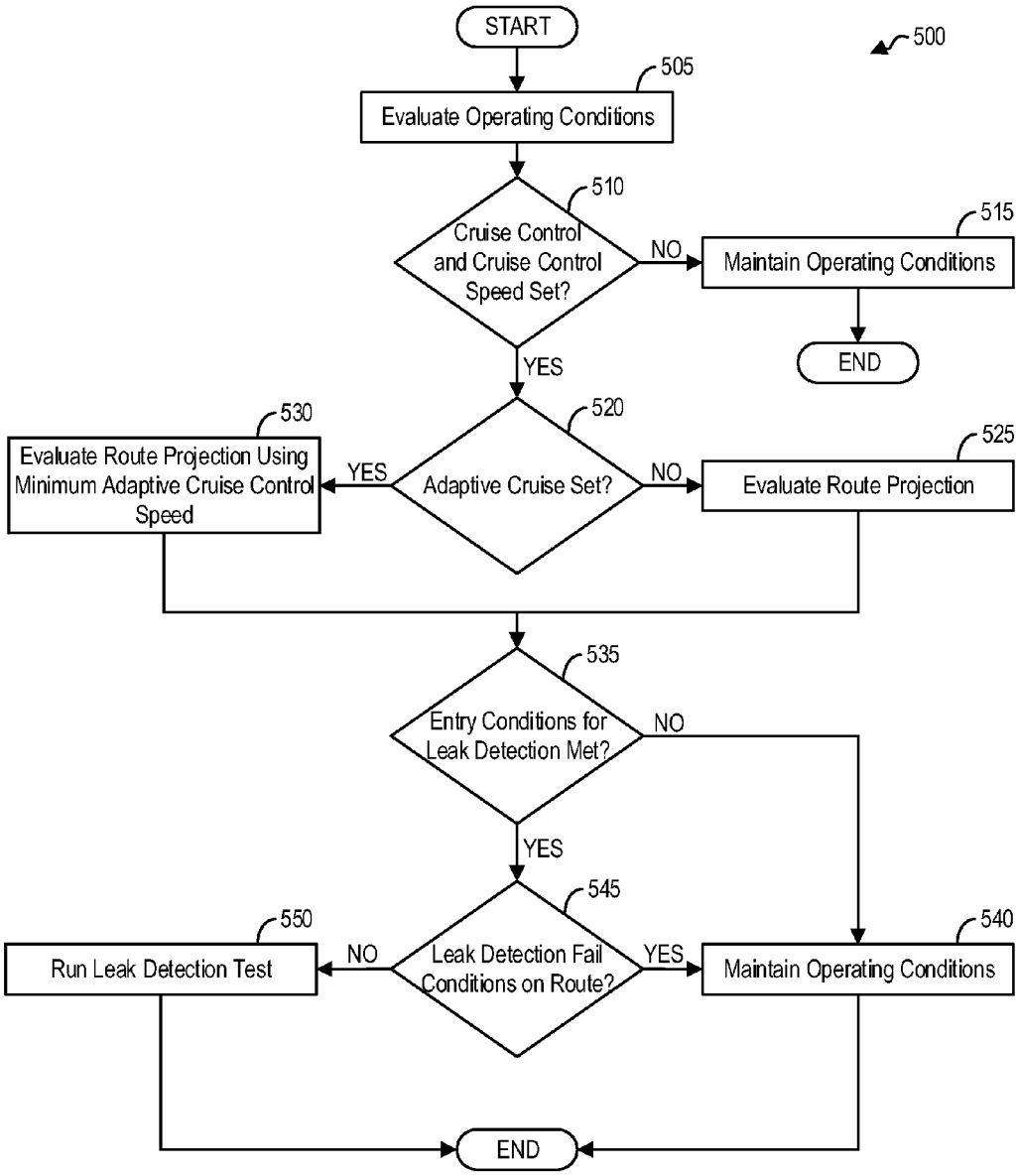
FIG. 5 shows a high-level flow chart illustrating an example method for using a route projection to initiate a leak detection test.
Figure 6:
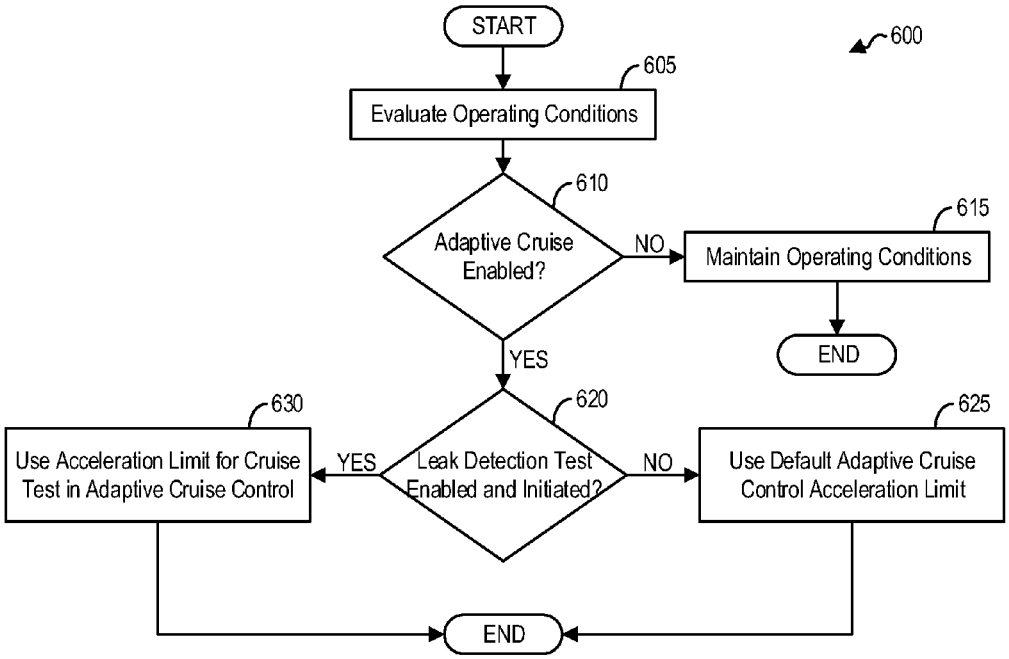
FIG. 6 shows a high-level flow chart illustrating an example method for modifying adaptive cruise control settings during a leak detection test.
Figure 7:
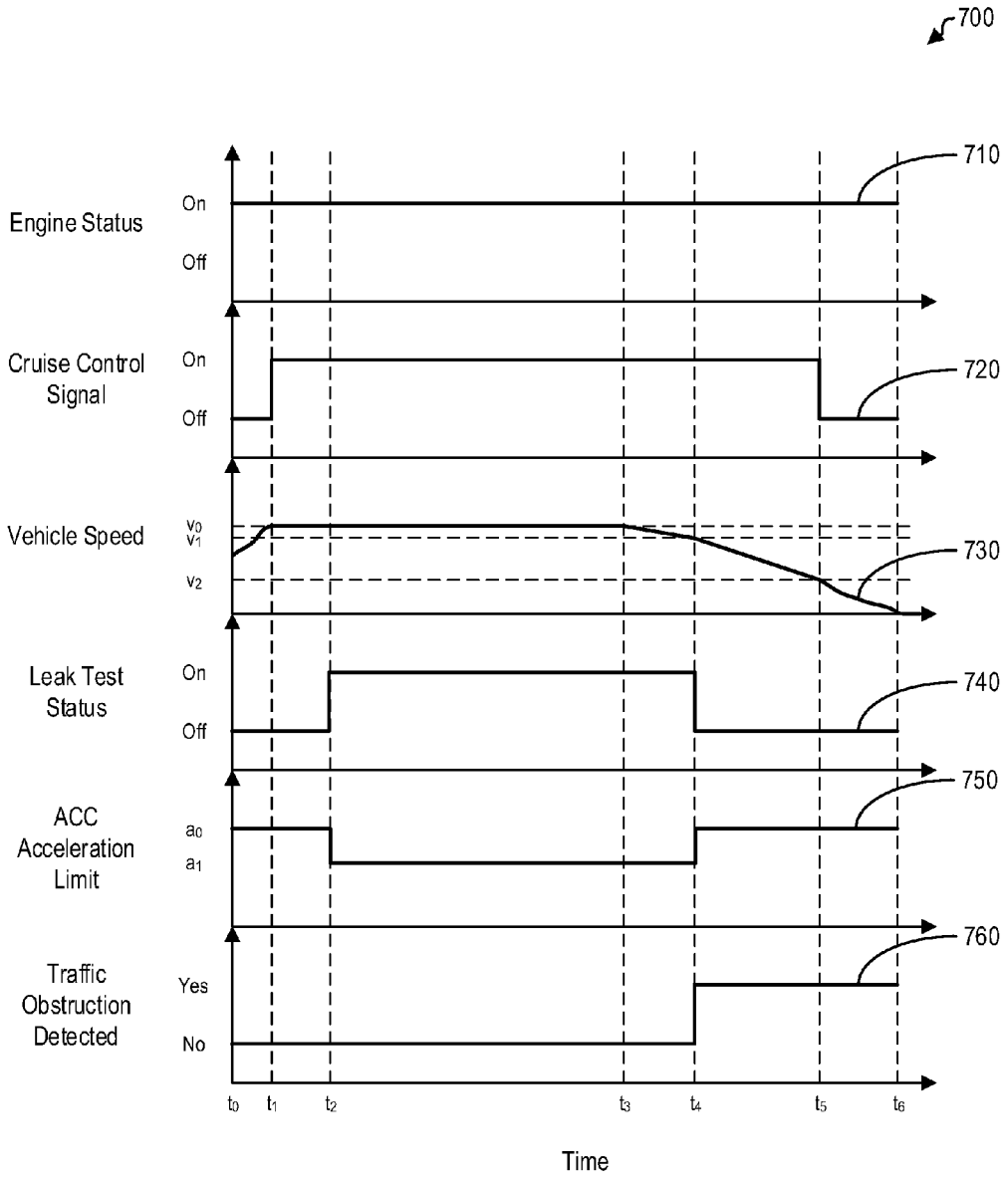
FIG. 7 shows a set of graphs illustrating example operation of a vehicle.

The following description relates to systems and methods for performing evaporative emissions leak detection in a vehicle. In particular, systems and methods are provided for performing engine-on fuel system leak detection tests in a vehicle equipped with a cruise control system, such as the vehicle depicted in FIG. 1. As depicted in FIG. 2, the vehicle may include a fuel system, an evaporative emissions system, a controller, and means of determining the vehicle's travel route. The vehicle may periodically perform tests to identify fuel system leaks. Such tests may be difficult to perform when the vehicle is in motion, as fuel sloshing in the fuel tank may affect the test results. Such difficulties may be avoided when the vehicle is utilizing cruise control, or operating in a cruise control-like mode, on a smooth, flat, straight road. Hence, a leak detection test may be initiated based on a route projection while the vehicle is operating in a cruise control mode, as depicted in FIG. 3, or while the vehicle is operating in a cruise control-like mode, as depicted in FIG. 4. In order to conserve resources, the route projection may further be used to prematurely abort the leak detection test if a change in the route projection would invalidate the test results. As depicted in FIG. 5, adaptive cruise may be considered when projecting the vehicle route, and the leak detection test may not run if the route projection includes certain fail conditions such as stop signs and variable road grade. In examples with adaptive cruise control, acceleration limits may be modified if a leak detection test is running, as depicted in FIG. 6. FIG. 7 depicts an example operation of a leak detection test in accordance with the current disclosure.

Figure 1:
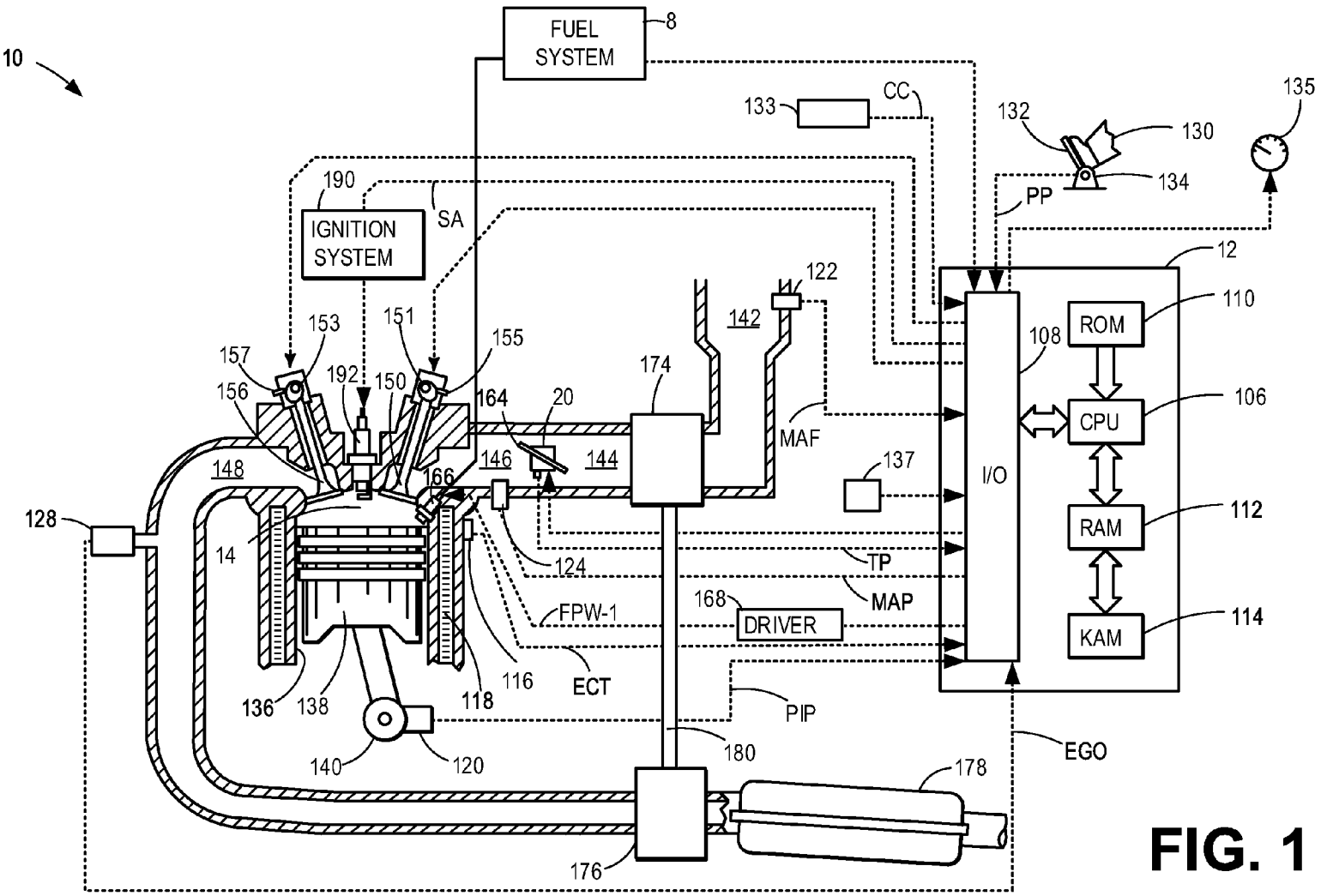
FIG. 1 shows an example engine system.

Referring now to the figures, FIG. 1 depicts an example embodiment of a combustion chamber or cylinder of internal combustion engine 10. Engine 10 may receive control parameters from a control system including controller 12 and input from a vehicle operator 130 via an input device 132. In this example, input device 132 includes an accelerator pedal and a pedal position sensor 134 for generating a proportional pedal position signal PP. Also included is an input switch 133 for generating a cruise control signal CC. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor may be coupled to crankshaft 140 via a flywheel to enable a starting operation of engine 10.

Cylinder 14 can receive intake air via a series of intake air passages 142, 144, and 146. Intake air passage 146 may communicate with other cylinders of engine 10 in addition to cylinder 14. In some embodiments, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 20 including a throttle plate 164 may be provided along an intake passage of the engine for varying the flow rate and/or pressure of intake air provided to the engine cylinders. For example, throttle 20 may be disposed downstream of compressor 174 as shown in FIG. 1, or alternatively may be provided upstream of compressor 174.

Exhaust passage 148 may receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three-way catalyst (TWC), NOx trap, various other emission control devices, or combinations thereof.

Exhaust temperature may be measured by one or more temperature sensors (not shown) located in exhaust passage 148. Alternatively, exhaust temperature may be inferred based on engine operating conditions such as speed, load, air-fuel ratio (AFR), spark retard, etc. Further, exhaust temperature may be computed by one or more exhaust gas sensors 128. It may be appreciated that the exhaust gas temperature may alternatively be estimated by any combination of temperature estimation methods listed herein.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams and may utilize one or more of cam profile switching (CPS), variable cam timing (VCT), variable valve timing (VVT), and/or variable valve lift (VVL) systems that may be operated by controller 12 to vary valve operation. The operation of intake valve 150 and exhaust valve 156 may be determined by valve position sensors (not shown) and/or camshaft position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation including CPS and/or VCT systems. In still other embodiments, the intake and exhaust valves may be controlled by a common valve actuator or actuation system, or a variable valve timing actuator or actuation system. A cam timing may be adjusted (by advancing or retarding the VCT system) to adjust an engine dilution in coordination with an EGR flow thereby reducing EGR transients and improving engine performance.

Cylinder 14 can have a compression ratio, which is the ratio of volumes when piston 138 is at bottom center to top center. Conventionally, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

As a non-limiting example, cylinder 14 is shown including one fuel injector 166. Fuel injector 166 is shown coupled directly to cylinder 14 for injecting fuel directly therein in proportion to the pulse width of signal FPW received from controller 12 via electronic driver 168. In this manner, fuel injector 166 provides what is known as direct injection (hereafter also referred to as "DI") of fuel into combustion chamber 14. While FIG. 1 shows injector 166 as a side injector, it may also be located overhead of the piston, such as near the position of spark plug 192. Fuel may be delivered to fuel injector 166 from a high pressure fuel system 8 including fuel tanks, fuel pumps, and a fuel rail. Alternatively, fuel may be delivered by a single stage fuel pump at lower pressure, in which case the timing of the direct fuel injection may be more limited during the compression stroke than if a high pressure fuel system is used. Further, while not shown, the fuel tanks may have a pressure transducer providing a signal to controller 12. It will be appreciated that, in an alternate embodiment, injector 166 may be a port injector providing fuel into the intake port upstream of cylinder 14.

As described above, FIG. 1 shows one cylinder of a multi-cylinder engine. As such, each cylinder may similarly include its own set of intake/exhaust valves, fuel injector(s), spark plug, etc.

While not shown, it will be appreciated that engine 10 may further include one or more exhaust gas recirculation (EGR) passages for diverting at least a portion of exhaust gas from the engine exhaust to the engine intake. As such, by recirculating some exhaust gas, an engine dilution may be affected which may reduce engine knock, peak cylinder combustion temperatures and pressures, throttling losses, and NOx emissions. The one or more EGR passages may include a low-pressure (LP) EGR passage coupled between the engine intake upstream of the turbocharger compressor and the engine exhaust downstream of the turbine, and configured to provide LP-EGR. The one or more EGR passages may further include a high-pressure (HP) EGR passage coupled between the engine intake downstream of the compressor and the engine exhaust upstream of the turbine, and configured to provide HP-EGR. In one example, an HP-EGR flow may be provided under conditions such as the absence of boost provided by the turbocharger, while an LP-EGR flow may be provided during conditions such as in the presence of turbocharger boost and/or when an exhaust gas temperature is above a threshold. The LP-EGR flow through the LP-EGR passage may be adjusted via n LP-EGR valve while the HP-EGR flow through the HP-EGR passage may be adjusted via an HP-EGR valve (not shown).

Controller 12 is shown in FIG. 1 as a microcomputer, including microprocessor unit 106, input/output ports 108, an electronic storage medium for executable programs and calibration values shown as read only memory chip 110 in this particular example, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and manifold absolute pressure signal (MAP) from sensor 124. Engine speed signal, RPM, may be generated by controller 12 from signal PIP. Engine speed may be displayed on tachometer 135. Manifold pressure signal MAP from a manifold pressure sensor may be used to provide an indication of vacuum, or pressure, in the intake manifold. Still other sensors may include fuel level sensors and fuel composition sensors coupled to the fuel tank(s) of the fuel system. Storage medium read-only memory 110 can be programmed with computer readable data representing instructions executable by processor 106 for performing the methods described below as well as other variants that are anticipated but not specifically listed.

The vehicle may further include a cruise control system operable to control, direct, and/or request control, such as with assistance from the controller 12, to engage and otherwise control operation of the engine 10, motor, and powertrain, including but not limited to controlling shifting operations of the powertrain/transmission according to a desired operational strategy. The cruise control system may be part of the engine controller of the vehicle or a separate component communicatively connected to the controller. The cruise control system may comprise a controller 12 comprising a processor 106 and memory, such as read only memory 110, and various sensors for measuring engine parameters and vehicle speed. The vehicle's powertrain control module (PCM), such as controller 12, may be capable of detecting if the vehicle is operating in a cruise-like mode based on vehicle speed, acceleration, and engine load, among others.

The cruise control system may be operatively coupled to the fuel supply system of the vehicle. The cruise control system may be adapted to at least one of increase or decrease the amount of fuel supplied to the engine to cause vehicle acceleration.

The cruise control system may be operatively coupled to the vehicle transmission. The cruise control system may be adapted to decouple the vehicle wheels from the engine. The cruise control system may be adapted to disengage a transmission clutch of the vehicle.

For example, one non-limiting aspect of the present invention contemplates the cruise control system being operable to control the vehicle in cruise control mode where a desired vehicle speed is automatically maintained, for example, without continuous driver interaction and/or manipulation of the accelerator pedal. The cruise control system may include a cruise control interface (not shown) operable to set the desired vehicle speed and receive other inputs from the user associated with performing cruise control functions, or in some cases a remote or wireless entity operable to control the vehicle.

The vehicle may further include a radar system 137 for measuring the distance between the vehicle and a preceding target vehicle (not shown) and also relative vehicle speed. Radar system 137 and cruise control system may comprise an adaptive cruise control (ACC) system. An ACC system can enhance performance of vehicle cruise control by allowing a vehicle to actively track and follow a target vehicle while maintaining a follow distance that is proportional to the timed headway between the vehicles plus some minimum distance. The speed of the follow vehicle is controlled by controlling the application of acceleration force to the vehicle over a range spanning positive and negative accelerations.

FIG. 2 shows a schematic depiction of a hybrid vehicle system 206 that can derive propulsion power from engine system 8 and/or an on-board energy storage device, such as a battery system (not shown). An energy conversion device, such as a generator (not shown), may be operated to absorb energy from vehicle motion and/or engine operation, and then convert the absorbed energy to an energy form suitable for storage by the energy storage device.

Engine system 208 may include an engine 210 having a plurality of cylinders 230. Engine 210 includes an engine intake 223 and an engine exhaust 225. Engine intake 223 includes an air intake throttle 262 fluidly coupled to the engine intake manifold 244 via an intake passage 242. Air may enter intake passage 242 via air filter 252. Engine exhaust 225 includes an exhaust manifold 248 leading to an exhaust passage 235 that routes exhaust gas to the atmosphere. Engine exhaust 225 may include one or more emission control devices 270 mounted in a close-coupled position. The one or more emission control devices 270 may include a three-way catalyst, lean NOx trap, diesel particulate filter, oxidation catalyst, etc. It will be appreciated that other components may be included in the engine such as a variety of valves and sensors, as further elaborated herein. In some embodiments, wherein engine system 208 is a boosted engine system, the engine system may further include a boosting device, such as a turbocharger (not shown).

Engine system 208 is coupled to a fuel system 218. Fuel system 218 includes a fuel tank 220 coupled to a fuel pump 221 and a fuel vapor canister 222. During a fuel tank refueling event, fuel may be pumped into the vehicle from an external source through refueling port 288. Fuel tank 220 may hold a plurality of fuel blends, including fuel with a range of alcohol concentrations, such as various gasoline-ethanol blends, including E10, E85, gasoline, etc., and combinations thereof. A fuel level sensor 286 located in fuel tank 220 may provide an indication of the fuel level ("Fuel Level Input") to controller 212. As depicted, fuel level sensor 286 may comprise a float connected to a variable resistor. Alternatively, other types of fuel level sensors may be used.

Fuel pump 221 is configured to pressurize fuel delivered to the injectors of engine 210, such as example injector 266. While only a single injector 266 is shown, additional injectors are provided for each cylinder. It will be appreciated that fuel system 218 may be a return-less fuel system, a return fuel system, or various other types of fuel systems. Vapors generated in fuel tank 220 may be routed to fuel vapor canister 222 via conduit 231 before being purged to the engine intake 223.

Fuel vapor canister 222 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 222 may be purged to engine intake 223 by opening canister purge valve 211. While a single canister 222 is shown, it will be appreciated that fuel system 218 may include any number of canisters. In one example, canister purge valve 211 may be a solenoid valve wherein opening or closing of the valve is performed via actuation of a canister purge solenoid.

Canister 222 may include a buffer 222*a* (or buffer region), each of the canister and the buffer comprising the adsorbent. As shown, the volume of buffer 222*a* may be smaller than (for example, a fraction of) the volume of canister 222. The adsorbent in the buffer 222*a* may be the same as, or different from, the adsorbent in the canister (for example, both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (for example, to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine.

Canister 222 includes a vent 227 for routing gases out of the canister 222 to the atmosphere when storing, or trapping, fuel vapors from fuel tank 220. Vent 227 may also allow fresh air to be drawn into fuel vapor canister 222 when purging stored fuel vapors to engine intake 223 via purge line 228 and purge valve 211. While this example shows vent 227 communicating with fresh, unheated air, various modifications may also be used. Vent 227 may include a canister vent valve 215 to adjust a flow of air and vapors between canister 222 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister. In one example, canister vent valve 215 may be a solenoid valve wherein opening or closing of the valve is performed via actuation of a canister vent solenoid. In particular, the canister vent valve may be an open valve that is closed up actuation of the canister vent solenoid.

As such, hybrid vehicle system 206 may have reduced engine operation times due to the vehicle being powered by engine system 208 during some conditions, and by the energy storage device under other conditions. While the reduced engine operation times reduce overall carbon emissions from the vehicle, they may also lead to insufficient purging of fuel vapors from the vehicle's emission control system. To address this, a fuel tank isolation valve 213 may be optionally included in conduit 231 such that fuel tank 220 is coupled to canister 222 via the valve 213. During regular engine operation, isolation valve 213 may be kept closed to limit the amount of diurnal or "running loss" vapors directed to canister 222 from fuel tank 220. During refueling operations, and selected purging conditions, isolation valve 213 may be temporarily opened (for example, for a duration) to direct fuel vapors from the fuel tank 220 to canister 222. By opening the valve during purging conditions when the fuel tank pressure is higher than a threshold (for example, above a mechanical pressure limit of the fuel tank above which the fuel tank and other fuel system components may incur mechanical damage), the refueling vapors may be released into the canister and the fuel tank pressure may be maintained below pressure limits. While the depicted example shows isolation valve 213 positioned along conduit 231, in alternate embodiments, the isolation valve may be mounted on fuel tank 220.

One or more pressure sensors 225 may be coupled to fuel system 218 for providing an estimate of a fuel system pressure. In one example, the fuel system pressure is a fuel tank pressure, wherein pressure sensor 225 is a fuel tank pressure sensor coupled to fuel tank 220 for estimating a fuel tank pressure or vacuum level. While the depicted example shows pressure sensor 225 directly coupled to fuel tank 220, in alternate embodiments, the pressure sensor may be coupled between the fuel tank and canister 222, specifically between the fuel tank and isolation valve 213. In yet other embodiments, a first pressure sensor may be positioned upstream of the isolation valve (between the isolation valve and the canister) while a second pressure sensor is positioned downstream of the isolation valve (between the isolation valve and the fuel tank) to provide an estimate of a pressure difference across the valve. In some examples, a vehicle control system 214 may infer and indicate a fuel system leak based on changes in a fuel tank pressure during a leak diagnostic routine.

One or more temperature sensors 226 may also be coupled to fuel system 218 for providing an estimate of a fuel system temperature. In one example, the fuel system temperature is a fuel tank temperature, wherein temperature sensor 226 is a fuel tank temperature sensor coupled to fuel tank 220 for estimating a fuel tank temperature. While the depicted example shows temperature sensor 226 directly coupled to fuel tank 220, in alternate embodiments, the temperature sensor may be coupled between the fuel tank and canister 222.

Fuel vapors released from canister 222, for example during a purging operation, may be directed into engine intake manifold 244 via purge line 228. The flow of vapors along purge line 228 may be regulated by canister purge valve 211, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 212, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 228 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) or manifold vacuum (ManVac) may be obtained from MAP sensor 283 coupled to intake manifold 244, and communicated with controller 212. Alternatively, MAP may be inferred from alternate engine operation conditions, such as mass air flow (MAF), as measured by a MAF sensor (not shown) coupled to the intake manifold 244.

Fuel system 218 may be operated by controller 212 in a plurality of modes by selective adjustment of the various valves and solenoids. For example, the fuel system may be operated in a fuel vapor storage mode (for example, during a fuel tank refueling operation and with the engine not running), wherein the controller 212 may open isolation valve 213 and canister vent valve 215 while closing canister purge valve (CPV) 211 to direct refueling vapors into canister 222 while preventing fuel vapors from being directed into the intake manifold.

As another example, the fuel system may be operated in a refueling mode (for example, when fuel tank refueling is requested by a vehicle operator), wherein the controller 212 may open isolation valve 213 and canister vent valve 215, while maintaining canister purge valve 211 closed, to depressurize the fuel tank before allowing fuel to be added therein. As such, isolation valve 213 may be kept open during the refueling operation to allow refueling vapors to be stored in the canister. After refueling is completed, the isolation valve may be closed.

As yet another example, the fuel system may be operated in a canister purging mode (for example, after an emission control device light-off temperature has been attained and with the engine running), wherein the controller 212 may open canister purge valve 211 and canister vent valve 215 while closing isolation valve 213. Herein, the vacuum generated by the intake manifold of the operating engine may be used to draw fresh air through vent 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. For example, one or more oxygen sensors (not shown) may be coupled to the canister 222 (for example, downstream of the canister), or positioned in the engine intake and/or engine exhaust, to provide an estimate of a canister load (that is, an amount of fuel vapors stored in the canister). Based on the canister load, and further based on engine operating conditions, such as engine speed-load conditions, a purge flow rate may be determined.

Vehicle system 206 may further include control system 214. Control system 214 is shown receiving information from a plurality of sensors 216 (various examples of which are described herein) and sending control signals to a plurality of actuators 281 (various examples of which are described herein). As one example, sensors 216 may include exhaust gas sensor 226 located upstream of the emission control device, temperature sensor 228, MAP sensor 283, pressure sensor 225, and pressure sensor 229. Other sensors such as additional pressure, temperature, air/fuel ratio, and composition sensors may be coupled to various locations in the vehicle system 206. As another example, the actuators may include fuel injector 266, isolation valve 213, purge valve 211, vent valve 215, fuel pump 221, and throttle 262.

Control system 214 may further receive information regarding the location of the vehicle from an on-board global positioning system (GPS). Information received from the GPS may include vehicle speed, vehicle altitude, vehicle position, etc. This information may be used to infer engine operating parameters, such as local barometric pressure. Control system 214 may further be configured to receive information via the internet or other communication networks. Information received from the GPS may be cross-referenced to information available via the internet to determine local weather conditions, local vehicle regulations, local traffic conditions, etc. Control system 214 may use the internet to obtain updated software modules which may be stored in non-transitory memory therein.

The control system 214 may include a controller 212. Controller 212 may be configured as a conventional microcomputer including a microprocessor unit, input/output ports, read-only memory, random access memory, keep alive memory, a controller area network (CAN) bus, etc. Controller 212 may be configured as a powertrain control module (PCM). The controller 212 may be shifted between sleep and wake-up modes for additional energy efficiency. The controller 212 may receive input data from the various sensors, process the input data, and trigger the actuators in response to the processed input data based on instruction or code programmed therein corresponding to one or more routines.

Controller 212 may also be configured to intermittently perform leak detection routines on fuel system 218 (for example, fuel vapor recovery system) to confirm that the fuel system is not degraded. As such, various diagnostic leak detection tests may be performed while the engine is off (engine-off leak test) or while the engine is running (engine-on leak test). Leak tests performed while the engine is running may include applying a negative pressure on the fuel system for a duration (for example, until a target fuel tank vacuum is reached) and then sealing the fuel system while monitoring a change in fuel tank pressure (for example, a rate of change in the vacuum level, or a final pressure value).

In one example, to perform an engine-on leak test, negative pressure generated at engine intake 223 is applied on the fuel system with CVV 215 closed until a threshold level is reached. In some embodiments, an evaporative leak check module (ELCM) may be coupled to fuel system 218, for example, in vent 227 between CVV 215 and atmosphere. The ELCM may include a pressure-generating means (for example, a vacuum pump or a positive pressure pump), and may be connected to the fuel system 218 via one or more actuatable valves, allowing for one or more sections of the fuel system to be isolated for leak testing.

As such, the leak tests performed may be vacuum-based or negative pressure leak tests. During the negative pressure leak test, CPV 211 and CVV 215 may be kept closed to isolate the fuel system. Vacuum may be applied to the fuel tank or canister side of the fuel system until a threshold vacuum level has been reached. Based on a rate of pressure bleed-up (to atmospheric pressure) and a final stabilized fuel system pressure, the presence of a fuel system leak may be determined. For example, in response to a bleed-up rate that is faster than a threshold rate, a leak may be determined.

In alternate examples, the leak test may be a positive pressure leak test wherein the pump of the ELCM may be a positive pressure pump. Therein, a positive pressure may be applied to the fuel tank or canister side of the fuel system until a threshold pressure level has been reached. Based on a rate of pressure bleed-down to atmospheric pressure and a final stabilized fuel system pressure, the presence of a fuel system leak may be determined.

During a leak test, changes in vacuum or pressure may be compared to expected changes based on operating and environmental conditions. Expected changes may be stored in controller 212, or may be empirically determined. In some examples, the ELCM may include one or more reference orifices corresponding to a potential leak size. For example, the ELCM may include a reference orifice with a 0.020" diameter. The leak test may include exerting a vacuum or positive pressure across the reference orifice(s), and comparing pressure changes across the reference orifice to pressure changes in the fuel system. The reference orifice may represent a threshold for leak detection, or may allow for calibration of various leak sizes. If the controller determines the presence of a leak greater than a threshold value, a malfunction indicator lamp (MIL) may be actuated.

FIG. 3 shows a high-level flow chart illustrating an example method 300 for a leak detection test in accordance with the current disclosure. In particular, method 300 relates to initiating a leak detection test responsive to a projected route of a vehicle operating in a cruise control mode, and canceling the leak detection test if the projected route changes. Method 300 will be described herein with reference to the components and systems depicted in FIGS. 1 and 2, though it should be understood that the method may be applied to other systems without departing from the scope of this disclosure. Method 300 may be carried out by controller 212, and may be stored as executable instructions in non-transitory memory therein.

Method 300 may begin at 305. At 305, method 300 may include evaluating operating conditions. Operating conditions may include, but are not limited to, vehicle speed, cruise control signal CC, engine load, engine coolant temperature, road grade, etc. Operating conditions may further include GPS data regarding the vehicle location, projected route and traffic information, and road conditions. Operating conditions may be measured by one or more sensors 216 coupled to controller 212, or may be estimated or inferred based on available data. Projected route information may be inferred based on a destination input by a driver via an interface and the vehicle location, on historical routes traveled and the vehicle location, on a predicted route given the physical conditions of the vehicle and the vehicle location, and so on. Traffic information and road conditions may be obtained, for example, from historical traffic information databases, live traffic information feeds, live accident report feeds, and the like.

Continuing at 310, method 300 may include determining if the cruise control mode is set. Determining if the cruise control mode is set may include, for example, determining if the input switch 133 is generating the cruise control signal CC and if a cruise control speed is set. If the cruise control mode is not set, method 300 may continue to 320, where the operating conditions evaluated at 305 are maintained. Method 300 may then end.

Returning to 310, if the cruise control mode is set, method 300 may continue to 315. At 315, method 300 may include evaluating a route projection. Evaluating a route projection may include determining where driving obstructions may be located along the projected route. Driving obstructions may include, for example, stop signs, traffic signals, congested traffic, vehicular accidents, speed limit changes, and the like.

The accuracy of a leak detection test may be increased by performing the leak detection test without significant external disturbances to the fuel system 218. External disturbances may include, for example, gravity acting on the fuel in fuel tank 220 while the vehicle travels along a road with a steep grade, or a significant change in momentum leading to sloshing fuel in the fuel tank 220. Such external disturbances may result in an inaccurate leak detection test result. Therefore, evaluating the route projection may further include identifying any path lengths within the projected route suitable for leak detection. For example, a path length suitable for leak detection may include a stretch of road with a consistently low road grade and zero driving obstructions, and may further feature zero hard turns. Evaluating the route projection may further include determining the travel time along identified path lengths suitable for leak detection in the projected route based on the cruise control speed.

At 325, method 300 may include determining if entry conditions for a leak detection test are met. Entry conditions may include a variety of engine and/or fuel system operating conditions and parameters. Additionally, in the case when the engine is included in a vehicle, entry conditions for leak detection may include a variety of vehicle conditions.

For example, entry conditions for leak detection may include a fuel level above a threshold value, as such a condition may lead to less available vapor within the fuel tank and larger potential pressure changes which may lead to higher accuracy during leak testing.

As another example, entry conditions for leak detection may include a temperature of one or more fuel system components in a predetermined temperature range. For example, temperatures which are too hot or too cold may decrease accuracy of leakage detection. Such a temperature range may depend on the method used to calculate the leak detection and the sensors deployed. However, in some examples, leak detection may occur at any temperature.

Additionally, entry conditions for leak detection may include whether or not a vehicle is in operation and the amount of power being drawn, for example, amount of torque, engine RPM, and so on, by the vehicle is less than a threshold value. For example, in the case of a hybrid vehicle, the vehicle may be in engine-off operation powered by an energy storage device. In this example, if there is a large draw of energy, for example in response to a large torque request, then, in some examples, leak detection may be postponed to reduce the power drawn from the battery. Thus entry conditions may be based on various operating conditions of the electric engine, such as speed, torque, and so on, or whether auxiliary components, for example, air conditioning, heat, or other processes, are using more than a threshold amount of stored energy.

As another example, entry conditions for leak detection may include an amount of time since a prior leak testing. For example, leak testing may be performed on a set schedule, for example, leak detection may be performed after a vehicle has traveled a certain amount of miles since a previous leak test or after a certain duration has passed since a previous leak detection test.

As yet another example, entry conditions for leak detection may include the possibility that a leak detection test may be accomplished during the projected route. For example, a leak detection test may be accomplished if estimated travel times based on cruise control speed along path lengths suitable for leak detection are greater than an estimated time for a leak detection test to successfully run. Thus entry conditions for leak detection may further include, for example, the presence of a suitable path length within the projected route, and the vehicle traveling along the identified suitable path length.

If entry conditions are not satisfied, method 300 may continue to 320 where the operating conditions evaluated at 305 are maintained and method 300 then ends. However, if entry conditions are satisfied, method 300 may continue to 330.

At 330, method 300 may include initiating a leak detection test. As described hereinabove with regard to FIG. 2, a leak detection test may include applying a negative pressure on the fuel system 218 for a duration (for example, until a target fuel tank vacuum is reached) and then sealing the fuel system while monitoring a change in fuel tank pressure (for example, a rate of change in the vacuum level, or a final pressure value). In one example, to perform the leak test, negative pressure generated at engine intake 223 is applied on the fuel system 218 until a threshold level is reached. Then, the fuel system 218 is isolated from the engine intake 244 by closing canister purge valve 211 and a rate of vacuum bleed-up is monitored. Based on the rate of change in fuel system vacuum, a fuel system leak can be identified. In another example, where at least some negative pressure is held in the fuel system 218 (such as at the fuel tank 220) before purging is stopped (via timed closing of the canister vent valve 215), the fuel system vacuum may be advantageously used during non-purging conditions to identify a fuel system leak. Specifically, the fuel tank vacuum/pressure may be monitored during the non-purging conditions and a leak may be determined based on the rate at which the fuel tank pressure bleeds up from the vacuum conditions to barometric pressure. In one example, a fuel system leak may be determined based on the rate of change in fuel tank pressure being larger than a threshold rate. In other examples, a leak detection test may include applying a positive pressure on fuel system 218 using a vacuum pump.

After initiating the engine-on leak detection test, method 300 may continue to 335. At 335, method 300 may include evaluating the route projection. Evaluating the route projection may include determining if the route projection has changed since evaluating the route projection at 315. Changes in the route projection may occur, for example, due to a recent traffic accident, the driver suddenly changing course, an onset of traffic congestion, and so on. During the leak detection test, the route projection may be continuously evaluated so that changes in the route projection may be detected.

Continuing at 340, method 300 may include determining if a change in the route projection is detected. Changes in the route projection may lead to a disablement of the cruise control, thereby terminating the leak detection test prior to its completion or in some examples yielding a false fail. For example, a traffic accident may result in highly congested traffic on the path length previously determined to be suitable for performing an accurate leak detection test. As a result, the vehicle may come to a stop, in some examples causing the cruise control function to disable. In some examples, the leak detection test may automatically abort when the cruise control is disabled. In an example where the leak detection test does not automatically abort when the cruise control is disabled, or if the cruise control is an adaptive cruise control and therefore may not disable, the vehicle coming to a stop may cause fuel to slosh around fuel tank 220, leading to an inaccurate leak detection test.

If a change in the route projection is detected, method 300 may continue to 345. At 345, method 300 may include aborting the leak detection test. Since the leak detection may terminate or the results of the leak detection test may be marked as invalid and discarded due to the anticipated change in the route projection, aborting the leak detection test as soon as the change is detected prevents further waste of energy and other resources. Method 300 may then end.

However, returning to 340, if a change in the route projection is not detected, method 300 may continue to 350. At 350, method 300 may include maintaining the leak detection test. Maintaining the leak detection test may comprise allowing the leak detection test to run through to completion.

Continuing at 355, method 300 may include determining if a leak greater than a leak threshold is detected. The leak threshold may depend on the leak detection test. For example, a leak detection test that utilizes positive pressure may be capable of testing for leaks of various sizes as described hereinabove with regard to FIG. 2. In another example, the leak threshold may depend on the geographical location of the vehicle. For example, some states in the United States have different regulations regarding evap system leak sizes. Thus, in so-called green states with strict regulations, the leak threshold may be smaller than a leak threshold in a non-green state. However, in some examples, the leak threshold may be the smallest possible leak size that the system is capable of detecting.

If a leak greater than a leak threshold is not detected, method 300 may continue to 360. At 360, method 300 may include indicating an absence of a leak. Indicating an absence of a leak may, for example, comprise logging the successful completion of the leak detection test and the null test result in control system 214. Method 300 may then end.

Returning to 355, if a leak greater than a leak threshold is detected, method 300 may continue to 365. At 365, method 300 may include indicating the presence of a leak. Indicating the presence of a leak may include, for example, logging the leak detection test failure and generating a diagnostic error code. Indicating the presence of a leak may further include actuating a malfunction indicator lamp (MIL). Method 300 may then end.

Thus a system and method are provided for initiating a leak detection test when a vehicle is operating in a cruise control mode. However, some drivers prefer to manually operate a vehicle instead of using cruise control, and some drivers do not even understand how to use cruise control. In such cases, a leak detection test may not be initiated in response to a cruise control mode because the cruise control mode is never activated. It is likely, however, that drivers who prefer to not use cruise control may operate a vehicle in cruise-control like conditions. For example, a driver may drive a vehicle at a constant speed, or a cruising speed. A method for initiating a leak detection test in response to a vehicle operating in such a cruising mode is described further herein and with regard to FIG. 4.

FIG. 4 shows a high-level flow chart illustrating an example method 400 for a leak detection test in accordance with the current disclosure. In particular, method 400 relates to initiating a leak detection test responsive to a projected route of a vehicle operating in a cruising mode, and canceling the leak detection test if the projected route changes. As described further herein, a cruising mode is a manual vehicle operating mode that resembles a cruise control mode, that is, the vehicle is being operated as if it were in cruise control mode. Method 400 will be described herein with reference to the components and systems depicted in FIGS. 1 and 2, though it should be understood that the method may be applied to other systems without departing from the scope of this disclosure. Method 400 may be carried out by controller 212, and may be stored as executable instructions in non-transitory memory therein.

Method 400 may begin at 405. At 405, method 400 may include evaluating operating conditions. Operating conditions may include, but are not limited to, vehicle speed, engine load, engine coolant temperature, road grade, etc. Operating conditions may further include GPS data regarding the vehicle location, projected route and traffic information, and road conditions. Operating conditions may be measured by one or more sensors 216 coupled to controller 212, or may be estimated or inferred based on available data. Projected route information may be inferred based on a destination input by a driver via an interface and the vehicle location, on historical routes traveled and the vehicle location, on a predicted route given the physical conditions of the vehicle and the vehicle location, and so on. Traffic information and road conditions may be obtained, for example, from historical traffic information databases, live traffic information feeds, live accident report feeds, and the like.

Continuing at 410, method 400 may include determining if cruising conditions are met. Cruising conditions comprise a set of conditions that resemble the conditions of a vehicle operating in a cruise control mode. For example, cruising conditions may include the vehicle speed remaining within a threshold range for a specified amount of time, a vehicle acceleration within a threshold range of zero for a specified amount of time, a nearly constant pedal position PP, and the like. Determining if cruising conditions are met may further include, for example, determining if operating conditions are similar to operating conditions during a cruise control mode. For example, cruise conditions may further include engine load, air flow, and so on. If cruising conditions are not met, method 400 may continue to 420, where the operating conditions evaluated at 405 are maintained. Method 400 may then end.

Returning to 410, if cruising conditions are met, method 400 may continue to 415. At 415, method 400 may include evaluating a route projection. Evaluating a route projection may include determining where driving obstructions may be located along the projected route. Driving obstructions may include, for example, stop signs, traffic signals, congested traffic, vehicular accidents, speed limit changes, and the like.

The accuracy of a leak detection test may be increased by performing the leak detection test without significant external disturbances to the fuel system 218. External disturbances may include, for example, gravity acting on the fuel in fuel tank 220 while the vehicle travels along a road with a steep grade, or a significant change in momentum leading to sloshing fuel in the fuel tank 220. Such external disturbances may result in an inaccurate leak detection test result. Therefore, evaluating the route projection may further include identifying any path lengths within the projected route suitable for leak detection. For example, a path length suitable for leak detection may include a stretch of road with a consistently low road grade and zero driving obstructions, and may further feature zero hard turns. Evaluating the route projection may further include determining the travel time along identified path lengths suitable for leak detection in the projected route based on a cruising speed, where the cruising speed is the average vehicle speed during the cruising conditions. In another example, the travel time may be based on the lower bound of the vehicle speed threshold range.

At 425, method 400 may include determining if entry conditions for a leak detection test are met. Entry conditions may include a variety of engine and/or fuel system operating conditions and parameters. Additionally, in the case when the engine is included in a vehicle, entry conditions for leak detection may include a variety of vehicle conditions.

For example, entry conditions for leak detection may include a fuel level above a threshold value, as such a condition may lead to less available vapor within the fuel tank and larger potential pressure changes which may lead to higher accuracy during leak testing.

As another example, entry conditions for leak detection may include a temperature of one or more fuel system components in a predetermined temperature range. For example, temperatures which are too hot or too cold may decrease accuracy of leakage detection. Such a temperature range may depend on the method used to calculate the leak detection and the sensors deployed. However, in some examples, leak detection may occur at any temperature.

Additionally, entry conditions for leak detection may include whether or not a vehicle is in operation and the amount of power being drawn, for example, amount of torque, engine RPM, and so on, by the vehicle is less than a threshold value. For example, in the case of a hybrid vehicle, the vehicle may be in engine-off operation powered by an energy storage device. In this example, if there is a large draw of energy, for example in response to a large torque request, then, in some examples, leak detection may be postponed to reduce the power drawn from the battery. Thus entry conditions may be based on various operating conditions of the electric engine, such as speed, torque, and so on, or whether auxiliary components, for example, air conditioning, heat, or other processes, are using more than a threshold amount of stored energy.

As another example, entry conditions for leak detection may include an amount of time since a prior leak testing. For example, leak testing may be performed on a set schedule, for example, leak detection may be performed after a vehicle has traveled a certain amount of miles since a previous leak test or after a certain duration has passed since a previous leak detection test.

As yet another example, entry conditions for leak detection may include the possibility that a leak detection test may be accomplished during the projected route. For example, a leak detection test may be accomplished if estimated travel times based on cruising speed along path lengths suitable for leak detection are greater than an estimated time for a leak detection test to successfully run. Thus entry conditions for leak detection may further include, for example, the presence of a suitable path length within the projected route, and the vehicle traveling along the identified suitable path length.

If entry conditions are not satisfied, method 400 may continue to 420 where the operating conditions evaluated at 405 are maintained and method 400 then ends. However, if entry conditions are satisfied, method 400 may continue to 430.

At 430, method 400 may include initiating a leak detection test. As described hereinabove with regard to FIG. 2, a leak detection test may include applying a negative pressure on the fuel system 218 for a duration (for example, until a target fuel tank vacuum is reached) and then sealing the fuel system while monitoring a change in fuel tank pressure (for example, a rate of change in the vacuum level, or a final pressure value). In one example, to perform the leak test, negative pressure generated at engine intake 223 is applied on the fuel system 218 until a threshold level is reached. Then, the fuel system 218 is isolated from the engine intake 244 by closing canister purge valve 211 and a rate of vacuum bleed-up is monitored. Based on the rate of change in fuel system vacuum, a fuel system leak can be identified. In another example, where at least some negative pressure is held in the fuel system 218 (such as at the fuel tank 220) before purging is stopped (via timed closing of the canister vent valve 215), the fuel system vacuum may be advantageously used during non-purging conditions to identify a fuel system leak. Specifically, the fuel tank vacuum/pressure may be monitored during the non-purging conditions and a leak may be determined based on the rate at which the fuel tank pressure bleeds up from the vacuum conditions to barometric pressure. In one example, a fuel system leak may be determined based on the rate of change in fuel tank pressure being larger than a threshold rate. In other examples, a leak detection test may include applying a positive pressure on fuel system 218 using a vacuum pump.

After initiating the engine-on leak detection test, method 400 may continue to 435. At 435, method 400 may include evaluating the route projection. Evaluating the route projection may include determining if the route projection has changed since evaluating the route projection at 415. Changes in the route projection may occur, for example, due to a recent traffic accident, the driver suddenly changing course, an onset of traffic congestion, the vehicle speed increasing or decreasing beyond a threshold range of the cruising speed, and so on. During the leak detection test, the route projection may be continuously evaluated so that changes in the route projection may be detected.

Continuing at 440, method 400 may include determining if a change in the route projection is detected. Changes in the route projection may lead to an abandonment of the cruising conditions, thereby terminating the leak detection test prior to its completion or in some examples yielding a false fail. For example, a traffic accident may result in highly congested traffic on the path length previously determined to be suitable for performing an accurate leak detection test. As a result, the vehicle may come to a stop. In some examples, the leak detection test may automatically abort when the operating conditions of the vehicle no longer satisfy the cruising conditions. In an example where the leak detection test does not automatically abort when the cruising conditions are abandoned, acceleration or deceleration of the vehicle may cause fuel to slosh around fuel tank 220, leading to an inaccurate leak detection test.

If a change in the route projection is detected, method 400 may continue to 445. At 445, method 400 may include aborting the leak detection test. Since the leak detection may terminate or the results of the leak detection test may be marked as invalid and discarded due to the anticipated change in the route projection, aborting the leak detection test as soon as the change is detected prevents further waste of energy and other resources. Method 400 may then end.

However, returning to 440, if a change in the route projection is not detected, method 400 may continue to 450. At 450, method 400 may include maintaining the leak detection test. Maintaining the leak detection test may comprise allowing the leak detection test to run through to completion.

Continuing at 455, method 400 may include determining if a leak greater than a leak threshold is detected. The leak threshold may depend on the leak detection test. For example, a leak detection test that utilizes positive pressure may be capable of testing for leaks of various sizes as described hereinabove with regard to FIG. 2. In another example, the leak threshold may depend on the geographical location of the vehicle. For example, some states in the United States have different regulations regarding evap system leak sizes. Thus, in so-called green states with strict regulations, the leak threshold may be smaller than a leak threshold in a non-green state. However, in some examples, the leak threshold may be the smallest possible leak size that the system is capable of detecting.

If a leak greater than a leak threshold is not detected, method 400 may continue to 460. At 460, method 400 may include indicating an absence of a leak. Indicating an absence of a leak may, for example, comprise logging the successful completion of the leak detection test and the null test result in control system 214. Method 400 may then end.

Returning to 455, if a leak greater than a leak threshold is detected, method 400 may continue to 465. At 465, method 400 may include indicating the presence of a leak. Indicating the presence of a leak may include, for example, logging the leak detection test failure and generating a diagnostic error code. Indicating the presence of a leak may further include actuating a malfunction indicator lamp (MIL). Method 400 may then end.

Thus systems and methods are provided for initiating a leak detection test during cruising conditions in general. As described hereinabove with regard to FIGS. 3 and 4, cruising conditions may comprise the conditions of a cruise control mode or a cruise control-like mode. In both modes, vehicle operation may be similar with the exception of the automatic maintenance of the vehicle speed during cruise control mode and the manual maintenance of the vehicle speed during a cruise control-like mode. Regardless of the particular mode, a route projection may be evaluated based on the cruising speed—whether the cruising speed is the nearly constant vehicle speed manually maintained or the specified cruise control speed—in order to determine if a leak detection test may successfully run. The leak detection test may not run if the route projection indicates any condition that may interrupt a cruise control mode or a cruising mode of the vehicle. However, in other examples the different modes may utilize different thresholds. For example, during a first mode including cruise control, a route projection may be based on a cruise control speed or may be based on a minimum adaptive cruise control speed as described further herein with regard to FIG. 5, and during a second non-cruise control mode where speed is within a threshold range over a duration, a route projection may be based on the lower bound of the threshold range.

FIG. 5 shows a high-level flow chart illustrating an example method 500 for initiating a leak detection test in accordance with the current disclosure. In particular, method 500 relates to initiating a leak detection test during cruise control mode after determining that no leak detection fail conditions are on the projected route. Method 500 will be described herein with reference to the components and systems depicted in FIGS. 1 and 2, though it should be understood that the method may be applied to other systems without departing from the scope of this disclosure. Method 500 may be carried out by controller 212, and may be stored as executable instructions in non-transitory memory therein.

Method 500 may begin at 505. At 505, method 500 may include evaluating operating conditions. Operating conditions may include, but are not limited to, vehicle speed, cruise control signal CC, engine coolant temperature, road grade, etc. Operating conditions may further include GPS data regarding the vehicle location, projected route and traffic information, and road conditions. Operating conditions may be measured by one or more sensors 216 coupled to controller 212, or may be estimated or inferred based on available data. Projected route information may be inferred based on a destination input by a driver via an interface and the vehicle location, on historical routes traveled and the vehicle location, on a predicted route given the physical conditions of the vehicle and the vehicle location, and so on. Traffic information and road conditions may be obtained, for example, from historical traffic information databases, live traffic information feeds, live accident report feeds, and the like.

At 510, method 500 may include determining if the cruise control mode is on and a cruise control speed is set.

Determining if the cruise control mode is on and a cruise control speed is set may include, for example, determining if the input switch 133 is generating the cruise control signal CC. The cruise control speed is the speed setpoint used by controller 212 for cruise control.

If the cruise control mode and a cruise control speed are not set, method 500 may continue to 515. At 515, method 500 may include maintaining operating conditions, such as those evaluated at 505. In this way, method 500 has no effect on operating conditions if the first entry condition, cruise control, is not present. Method 500 may then end.

Returning to 510, if the cruise control mode and a cruise control speed are set, method 500 may continue to 520. At 520, method 500 may include determining if adaptive cruise is set. As described hereinabove with regard to FIG. 1, adaptive cruise utilizes a radar system 137 to adjust vehicle speed and thereby maintain a minimum headway distance between the vehicle and a preceding vehicle. Furthermore, the ACC system may include a threshold ACC speed below which the adaptive cruise control disengages. For example, if the threshold ACC speed is 20 miles per hour, if the vehicle is controlled by adaptive cruise control and a preceding vehicle decelerates to a speed below 20 miles per hour, the adaptive cruise control may disengage after the vehicle reaches a speed of 20 miles per hour so that the driver may resume full control of the vehicle. In other examples, such a threshold ACC speed may be above or below 20 miles per hour. In yet other examples, the threshold ACC speed may be 0 miles per hour. In some examples, the ACC threshold speed may be specified by the driver.

If adaptive cruise is set, method 500 may proceed to 530. At 530, method 500 may include evaluating a route projection using the minimum adaptive cruise control speed. The minimum adaptive cruise control speed may comprise the threshold ACC speed described hereinabove. Evaluating a route projection may include determining where driving obstructions may be located along the projected route. Driving obstructions may include, for example, stop signs, traffic signals, congested traffic, vehicular accidents, speed limit changes, and the like.

The accuracy of a leak detection test may be increased by performing the leak detection test without significant external disturbances to the fuel system 218. External disturbances may include, for example, gravity acting on the fuel in fuel tank 220 while the vehicle travels along a road with a steep grade, a rapid grade change, a winding road, a rough road, and/or other significant changes in momentum leading to sloshing fuel in the fuel tank 220. Such external disturbances may result in an inaccurate leak detection test result. Therefore, evaluating the route projection may further include identifying any path lengths within the projected route suitable for leak detection. For example, a path length suitable for leak detection may include a stretch of road with a consistently low road grade and zero driving obstructions, and may further feature zero hard turns. Evaluating the route projection may further include determining the travel time along identified path lengths suitable for leak detection in the projected route based on the minimum adaptive cruise control speed. Using the minimum adaptive cruise control speed to evaluate the route projection provides an upper limit of the route projection. For example, since the vehicle may travel faster than the minimum adaptive cruise control speed throughout the route, a route projection based on the minimum adaptive cruise control speed may include the longest trip times possible with an enabled adaptive cruise control. In this way, evaluating the route projection may include more conservative predictions.

Returning to 520, if adaptive cruise is not set, method 500 may continue to 525. At 525, method 500 may include evaluating a route projection using the cruise control speed. As described hereinabove, evaluating a route projection may include determining where driving obstructions may be located along the projected route. Driving obstructions may include, for example, stop signs, traffic signals, congested traffic, vehicular accidents, speed limit changes, and the like. Evaluating the route projection may further include identifying any path lengths within the projected route suitable for leak detection. For example, a path length suitable for leak detection may include a stretch of road with a consistently low road grade and zero driving obstructions, and may further feature zero hard turns. Evaluating the route projection may further include determining the travel time along identified path lengths suitable for leak detection in the projected route based on the cruise control speed. Evaluating the route projection using the cruise control speed provides a more accurate prediction of travel times.

In some examples, if adaptive cruise is set, method 500 may include evaluating the route projection using both the minimum adaptive cruise control speed and the cruise control speed.

Whether adaptive cruise is set or not, method 500 may continue to 535 after evaluating the route projection. At 535, method 500 may include determining if entry conditions for leak detection are met. As described hereinabove with regard to FIG. 3, entry conditions may include a variety of engine and/or fuel system operating conditions and parameters. Additionally, in the case when the engine is included in a vehicle, entry conditions for leak detection may include a variety of vehicle conditions.

For example, entry conditions for leak detection may include a fuel level above a threshold value, as such a condition may lead to less available vapor within the fuel tank and larger potential pressure changes which may lead to higher accuracy during leak testing.

As another example, entry conditions for leak detection may include a temperature of one or more fuel system components in a predetermined temperature range. For example, temperatures which are too hot or too cold may decrease accuracy of leakage detection. Such a temperature range may depend on the method used to calculate the leak detection and the sensors deployed. However, in some examples, leak detection may occur at any temperature.

Additionally, entry conditions for leak detection may include whether or not a vehicle is in operation and the amount of power being drawn, for example, amount of torque, engine RPM, and so on, by the vehicle is less than a threshold value. For example, in the case of a hybrid vehicle, the vehicle may be in engine-off operation powered by an energy storage device. In this example, if there is a large draw of energy, for example in response to a large torque request, then, in some examples, leak detection may be postponed to reduce the power drawn from the battery. Thus entry conditions may be based on various operating conditions of the electric engine, such as speed, torque, and so on, or whether auxiliary components, for example, air conditioning, heat, or other processes, are using more than a threshold amount of stored energy.

As another example, entry conditions for leak detection may include an amount of time since a prior leak testing. For example, leak testing may be performed on a set schedule, for example, leak detection may be performed after a vehicle has traveled a certain amount of miles since a previous leak test or after a certain duration has passed since a previous leak detection test.

As yet another example, entry conditions for leak detection may include the possibility that a leak detection test may be accomplished during the projected route. For example, a leak detection test may be accomplished if estimated travel times based on cruise control speed along path lengths suitable for leak detection are greater than an estimated time for a leak detection test to successfully run. Thus entry conditions for leak detection may further include, for example, the presence of a suitable path length within the projected route, and the vehicle traveling along the identified suitable path length.

If entry conditions for leak detection are not met, method 500 may continue to 540. At 540, method 500 may include maintaining operating conditions, such as those evaluated at 505. In this way, the operation of the vehicle may continue and an engine-on leak detection test may not initiate if controller 212 does not determine that all conditions are suitable for an effective leak detection test. Method 500 may then end.

Returning to 535, if entry conditions for leak detection are met, method 500 may continue to 545. At 545, method 500 may include determining if leak detection fail conditions are present on the projected route. As discussed hereinabove, a leak detection test is most effective when as many variables as possible may be held constant during the test, such as temperature, volume, vapor density, and so on. As the leak detection test is an engine-on leak detection test, maintaining the vehicle in a stable configuration is highly desirable for the duration of the test. Thus, leak detection fail conditions may comprise elements of the projected route that may lead to an inaccurate leak detection test result which may include, but are not limited to, a stop sign, a traffic light, a traffic jam, a winding road, an unsuitable hill and valley, a rough road, and the like. Such leak detection fail conditions may lead to sloshing of fuel in the fuel tank, and may thereby alter the thermodynamic state of the fuel system. In examples where the vehicle is at least partially an electric vehicle, leak detection fail conditions may further include the presence of an electric vehicle (EV) zone on the projected route. An EV zone requires that an at least partially electric vehicle operate in EV mode, that is, engine use is disabled while present in the EV zone. If engine use is disabled, vapor purging is not allowed. In some examples, during a leak test a vapor purge may be held to a specified constant level, and so the engine must be running during the leak test. Further, shutting off the engine when entering an EV zone may lead to a sudden engine load change, which may disturb the leak test. Thus the presence of an EV zone on the projected route may comprise an undesirable condition for a leak test.

If leak detection fail conditions are present on the projected route, method 500 may continue to 540. At 540, method 500 may include maintaining operating conditions, such as those evaluated at 505. Method 500 may then end. In this way, controller 212 may not initiate a leak detection test if the accuracy of the test may be compromised or if the test may be prematurely canceled, thereby conserving energy and other resources that would otherwise be wasted by running the leak detection test.

Returning to 545, if leak detection fail conditions are not present on the projected route, method 500 may continue to 550. At 550, method 500 may include running a leak detection test. Running the leak detection test may comprise any engine-on leak detection method of the fuel system 218, for example a negative or positive pressure/vacuum test of fuel system 218. Method 500 may then end. In this way, controller 212 may run a leak detection test if a wide variety of leak detection test entry conditions are satisfied, including engine, fuel system, and vehicle operating conditions and parameters. In particular, controller 212 may run a leak detection test if a stable vehicle configuration is predicted along a projected route of the vehicle.

FIG. 6 shows a high-level flow chart illustrating an example method 600 for modifying adaptive cruise control settings during a leak detection test in accordance with the current disclosure. In particular, method 600 relates to setting specified acceleration limits for adaptive cruise control during a leak detection test, where the specified acceleration limits may be more conservative than default acceleration limits in order to minimize disturbances to the fuel system during a leak detection test. Method 600 will be described herein with reference to the components and systems depicted in FIGS. 1 and 2, though it should be understood that the method may be applied to other systems without departing from the scope of this disclosure. Method 600 may be carried out by controller 212, and may be stored as executable instructions in non-transitory memory therein.

Method 600 may begin at 605. At 605, method 600 may include evaluating operating conditions. Operating conditions may include, but are not limited to, vehicle speed, cruise control signal CC, engine coolant temperature, road grade, etc. Operating conditions may further include GPS data regarding the vehicle location, projected route and traffic information, and road conditions. Operating conditions may be measured by one or more sensors 216 coupled to controller 212, or may be estimated or inferred based on available data. Projected route information may be inferred based on a destination input by a driver via an interface and the vehicle location, on historical routes traveled and the vehicle location, on a predicted route given the physical conditions of the vehicle and the vehicle location, and so on. Traffic information and road conditions may be obtained, for example, from historical traffic information databases, live traffic information feeds, live accident report feeds, and the like.

At 610, method 600 may include determining if adaptive cruise is enabled. If adaptive cruise is not enabled, method 600 may continue to 615. At 615, method 600 may include maintaining operating conditions, such as the operating conditions evaluated at 605. Method 600 may then end.

Returning to 610, if adaptive cruise is enabled, method 600 may continue to 620. At 620, method 600 may include determining if a leak detection test is enabled and initiated. Determining if a leak detection test is enabled and initiated may comprise determining if controller 212 is running a leak detection test. Determining if a leak detection test is enabled and initiated may comprise determining if controller 212 is at least at step 330 of method 300 or step 550 of method 500.

If a leak detection test is not enabled and initiated, method 600 may proceed to 625. At 625, method 600 may include using a default adaptive cruise control acceleration limit. An adaptive cruise control acceleration limit may specify the maximum positive and/or negative acceleration rate that a vehicle may utilize while operating in an adaptive cruise control mode. The default adaptive cruise control acceleration limit may be an acceleration limit specified by original factory settings of controller 212 or, in some examples, may be specified by a user of the vehicle. A default acceleration limit may be specified, for example, such that occupants of the vehicle do not experience discomfort during vehicle acceleration or deceleration. Method 600 may then end.

Returning to 620, if a leak detection test is enabled and initiated, method 600 may proceed to 630. At 630, method 600 may include using an acceleration limit for a cruise test in adaptive cruise control, where a cruise test comprises a leak detection test performed during cruise control conditions, such as the leak detection tests of methods 300 and 500 described hereinabove. An acceleration limit for a cruise test in adaptive cruise control may comprise an acceleration limit particularly specified such that the cruise test may run without disturbances if and/or when the adaptive cruise control causes the vehicle to decelerate or accelerate during the cruise test. For example, the acceleration limit for a cruise test may be specified such that fuel in fuel tank 220 does not experience significant forces, or does not slosh, in response to acceleration or deceleration. As such, an acceleration limit for a cruise test may be more conservative than a default adaptive cruise control acceleration limit. In some examples, the acceleration limit for a cruise test may be below a threshold, the threshold based on engine, fuel system, and/or vehicle operating conditions and parameters. For example, the fuel system may be more sensitive to disturbances produced by acceleration and deceleration during a cruise test for some fuel system operating conditions and parameters, such that the accuracy of a leak detection test is affected by the automatic acceleration and deceleration. Therefore the threshold may be low such that any acceleration is conservative. As another example, the fuel system may be more robust to disturbances during a cruise test for some fuel system operating conditions and parameters, such that the accuracy of a leak detection test is not significantly affected by more rapid acceleration or deceleration. Therefore the acceleration limit threshold used during a cruise test may be larger than in other examples, or less conservative.

In this way, adaptive cruise control settings may be modified during a leak detection test so that the leak detection test may not be significantly affected by the automatic acceleration and/or deceleration of the vehicle. Note that the adaptive cruise control acceleration limit may return to the default setting once the leak detection test concludes. Method 600 may then end.

FIG. 7 shows a set of graphs 700 illustrating an example operation of a vehicle in accordance with the current disclosure. In particular, the set of graphs 700 depicts the operation of a vehicle, the vehicle including a controller configured with the methods discussed hereinabove with regard to FIGS. 3, 5, and 6, wherein an engine-on leak detection test is initiated during a cruise control mode when no traffic obstructions are detected. Set of graphs 700 includes a plot 710 of engine status over time, a plot 720 of a cruise control signal over time, a plot 730 of a vehicle speed over time, a plot 740 of a leak detection test status over time, a plot 750 of automatic cruise control (ACC) acceleration limits over time, and a plot 760 of a traffic obstruction detection over time.

At time $t_0$, the vehicle may be, for example, traveling down a long, flat, smooth, straight freeway with little traffic. Hence the engine status depicted by plot 710 is on. Further, no traffic obstructions are detected as depicted by plot 760.

At time $t_1$, the driver of the vehicle has accelerated the vehicle to a desired cruising speed $v_0$ and enables a cruise control mode, as shown respectively by plots 730 and 720. From times $t_1$ to $t_2$, the vehicle controller evaluates a route projection (not shown) based on vehicle speed $v_0$ and determines that leak detection test entry conditions are satisfied. The vehicle continues cruising down the freeway at speed $v_0$.

At time $t_2$, an engine-on leak detection test is initiated as depicted by plot 740. In this example, the vehicle is equipped with automatic cruise control (ACC). As depicted by plot 750, the controller adjusts the ACC acceleration limits from a default acceleration limit $a_0$ to a lower modified acceleration limit $a_1$. The leak detection test runs while the vehicle continues cruising down the freeway at speed $v_0$.

At some point between times $t_2$ and $t_3$, at some distance ahead of the vehicle, for example one mile, a vehicle gets into an accident in the middle of the freeway and begins obstructing traffic. At time $t_3$, the ACC system detects that a preceding vehicle is slowing down and so the vehicle begins to decelerate according to the modified acceleration limit $a_1$. From times t3 to t4, the vehicle speed decreases from $v_0$ to $v_1$, such that the magnitude of $(v_1-v_0)/(t_4-t_3)$ equals $a_1$.

During the cruise test, the vehicle controller continuously evaluates the route projection to determine the presence of traffic obstructions. At time $t_4$, the vehicle controller detects a traffic obstruction on the projected route, namely the car accident ahead that is causing traffic to slow down, as depicted by plot 760. Since the vehicle will be coming to a stop due to the traffic obstruction, thereby prematurely terminating the leak test, the vehicle controller cancels the leak test as shown by plot 740. The ACC acceleration limit returns to the default setting $a_0$ as shown by plot 750. Note that the cruise control signal is still on as depicted by 720, as the driver has not yet disabled cruise control and is allowing the ACC system to handle the deceleration of the vehicle.

From times $t_4$ to $t_5$, the vehicle speed decreases from a speed $v_1$ to speed $v_2$ as depicted by plot 730 such that the magnitude of $(v_2-v_1)/(t_5-t_4)$ equals the acceleration limit $a_0$. At time $t_5$, cruise control is disabled as shown by plot 720. In one example, vehicle speed $v_2$ may be a threshold speed below which the automatic cruise control mode automatically disengages. In another example, the driver manually terminates the cruise control mode after realizing that a traffic accident is ahead and that he or she must come to a stop. The driver applies brakes to the vehicle so that the vehicle speed decreases to zero, as shown by plot 730.

In this way, a leak test may be initiated by the controller during optimal testing conditions. As illustrated in the example of FIG. 7, a vehicle controller may evaluate a route projection based on a cruising speed when a vehicle has a cruise control mode enabled. If no obstructions are found on the projected route that would cause the vehicle to come to a stop, thereby terminating cruise control or decreasing the validity of a leak test result, a leak test may run. Furthermore, for vehicles equipped with automatic cruise control, ACC acceleration limits may be modified to a more conservative acceleration limit during a cruise control leak test. In this way, a leak test may not be disturbed by automatic acceleration and deceleration of a vehicle. Even further, if a traffic obstruction is detected or if any deviation in the projected route arises during a cruise control leak test that may lead to the premature termination of a leak test or a decreased accuracy of the leak test result, the leak test may be aborted when the obstruction or deviation is detected. In this way, minimal resources are wasted on leak tests.

In one embodiment, a method comprises initiating a leak test via an electronic controller in a vehicle responsive to selected route conditions. In one example, the selected route conditions include predicted low traffic. In another example, the selected route conditions include an estimated travel time without stopping. In yet another example, the selected route conditions include a consistently low road grade. In another example, the selected route conditions include a smooth road. In one example, the selected route conditions include an absence of traffic stops.

The method further comprises aborting the leak test responsive to a deviation from the selected route. In one example, the selected route conditions are based on GPS data. In another example, the selected route conditions are based on traffic data obtained via a wireless network.

In another embodiment, a method comprises evaluating a projected route responsive to receiving a cruise control signal, and initiating a leak test responsive to selected entry conditions. Evaluating the projected route comprises identifying a location of traffic obstructions along the projected route and the selected entry conditions include an absence of the traffic obstructions. The traffic obstructions may include one or more of a stop sign, a traffic signal, a traffic accident, congested traffic, or a speed limit change.

In one example, evaluating the projected route comprises calculating a travel time along a path length of the projected route without the traffic obstructions. In this example, the selected entry conditions further include the travel time along the path length greater than a leak test duration. In one example, calculating the travel time along the path length is based on a cruising speed. In another example, calculating the travel time along the path length is based on a minimum adaptive cruise speed. In some examples, the selected entry conditions include engine and fuel system operating conditions and parameters.

In yet another embodiment, a method comprises initiating a leak test responsive to receiving a cruise control signal, and modifying adaptive cruise control acceleration limits responsive to initiating the leak test. Modifying the adaptive cruise control acceleration limits comprises decreasing the adaptive cruise control acceleration limits below a threshold. In one example, the threshold is based on fuel system operating conditions and parameters. The method further comprises restoring default adaptive cruise control acceleration limits responsive to a conclusion of the leak test.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

determining a default acceleration limit and a modified acceleration limit for a vehicle, wherein the modified acceleration limit is lower than the default acceleration limit, and wherein the default and modified acceleration limits each specify a maximum acceleration for the vehicle to utilize while operating in an adaptive cruise control mode;

operating the vehicle in the adaptive cruise control mode with the default acceleration limit;

while operating the vehicle in the adaptive cruise control mode, upon initiation of a leak test via an electronic controller in the vehicle responsive to selected route conditions, decreasing the maximum acceleration from the default acceleration limit to the modified acceleration limit; and upon completion of the leak test, increasing the maximum acceleration from the modified acceleration limit to the default acceleration limit.

2. The method of claim 1, wherein the selected route conditions include predicted low traffic by the electronic controller.

3. The method of claim 1, wherein the selected route conditions include an estimated travel time without stopping.

4. The method of claim 1, wherein the selected route conditions include a consistently low road grade.

5. The method of claim 1, wherein the selected route conditions include a smooth road.

6. The method of claim 1, wherein the selected route conditions include an absence of traffic stops.

7. The method of claim 1, further comprising aborting the leak test responsive to a deviation from the selected route conditions, and increasing the maximum acceleration from the modified acceleration limit to the default acceleration limit.

8. The method of claim 1, wherein the selected route conditions are based on GPS data.

9. The method of claim 1, wherein the selected route conditions are based on traffic data obtained via a wireless network.

10. The method of claim 1 further comprising evaluating a projected route of the vehicle while operating the vehicle in the adaptive cruise control mode with the default acceleration limit, wherein evaluating the projected route comprises identifying a location of traffic obstructions along the projected route and the selected route conditions include an absence of the traffic obstructions.

11. The method of claim 10, wherein the traffic obstructions include one or more of a stop sign, a traffic signal, a traffic accident, congested traffic, or a speed limit change.

12. The method of claim 10, wherein evaluating the projected route comprises calculating a travel time along a path length of the projected route without the traffic obstructions, and wherein the selected route conditions further include the travel time along the path length of the projected route greater than a leak test duration.

13. The method of claim 12, wherein the calculation of the travel time along the path length of the projected route is based on a minimum adaptive cruise control speed.

14. The method of claim 1, wherein the selected route conditions include engine and fuel system operating conditions and parameters.

15. The method of claim 1, wherein the default acceleration limit is specified by original factory settings of the electronic controller or by a user of the vehicle.

16. A method, comprising:

determining a default acceleration limit and a modified acceleration limit for a vehicle, wherein the modified acceleration limit is lower than the default acceleration limit and lower than a threshold, the threshold based on operating conditions and parameters of a fuel system of the vehicle, and wherein the default and modified acceleration limits each specify a maximum acceleration for the vehicle to utilize while operating in an adaptive cruise control mode;

operating the vehicle in the adaptive cruise control mode with the default acceleration limit; and responsive to initiation of a leak test while operating the vehicle in the adaptive cruise control mode, decreasing the maximum acceleration from the default acceleration limit to the modified acceleration limit.

17. The method of claim 16, further comprising increasing the maximum acceleration from the modified acceleration limit to the default acceleration limit responsive to a conclusion of the leak test.

18. The method of claim 16, wherein the default acceleration limit is specified by original factory settings of an electronic controller of the vehicle or by a user of the vehicle.

* * * * *